United States Patent [19]

Longenecker

[11] 4,199,652

[45] Apr. 22, 1980

[54] AIR COOLED ELECTRIC ARC FURNACE

[76] Inventor: Levi S. Longenecker, 61 Mayfair Dr., Pittsburgh, Pa. 15228

[21] Appl. No.: 10,702

[22] Filed: Feb. 9, 1979

[51] Int. Cl.[2] ..... F27D 1/12

[52] U.S. Cl. ..... 13/32; 110/336; 432/238

[58] Field of Search ..... 13/32, 35; 110/336; 432/238

[56] References Cited

U.S. PATENT DOCUMENTS

| | | | |
|---|---|---|---|
| 3,315,950 | 4/1967 | Potocnik et al. | 13/32 X |
| 3,777,043 | 12/1973 | O'Neill | 13/32 |
| 4,091,228 | 5/1978 | Brown, Jr. et al. | 13/32 |
| 4,129,172 | 12/1978 | Snee, Jr. | 13/35 X |

*Primary Examiner*—Roy N. Envall, Jr.
*Attorney, Agent, or Firm*—Parmelee, Miller, Welsh & Kratz

[57] ABSTRACT

An electric arc melting furnace for metal has a roof liftably positioned on a funnel-shaped refractory mouth portion, has conventional electrode openings therethrough, and provides for a smoke hole through which fumes may be exhausted. A cooling fluid-receiving circulating metal duct is positioned to extend along and in a somewhat supporting relation with respect to an outer periphery of the funnel-shaped mouth portion for introducing cooling fluid into J-shaped, heat chambers that are positioned in a circumferentially spaced relation within and about a refractory side wall in such a manner as to provide for a maximum cooling action adjacent a sill area of the furnace. Cooling-fluid-receiving and circulating chambers in the side wall are, in effect, closed or sealed-off with respect to each other. Warmed fluid or air exhausting from the chambers in the side wall may be used for heating cooler areas inside the furnace, for outside furnace discharge for room heating, etc., or may be employed for supplying air to burners located about the furnace to heat colder areas therewithin.

21 Claims, 9 Drawing Figures

AIR COOLED ELECTRIC ARC FURNACE

BACKGROUND OF THE INVENTION

This invention pertains to a furnace that is improved from the standpoint of the life and maintenance of its refractory walls, and wherein a substantial equailization of temperatures may be attained about the inside of its walls during a melting operation. A further aspect deals with adding flexibility to the use of an electric arc furnace, while at the same time, increasing the life of its refractory members and enabling effective utilization and conservation of heat extracted from its side walls. As to the prior art, as far as known, there have not heretofore been any practical constructions for providing temperature control of the refractory side walls of a metal melting furnace and particularly, from the standpoint of its refractory tile members.

CROSS REFERENCE TO RELATED PATENTS OR APPLICATIONS

In my U.S. Pat. No. 4,063,208 I have disclosed an improved liftable roof for an electric furnace that is of a dual ring structure, and in my copending application Ser. No. 867,281 of Jan. 5, 1978 now U.S. Pat. No. 4,146,742, I have disclosed an electric furnace construction having a two-part roof for facilitating its maintenance and particularly, for enabling repair of a hotter central portion thereof about the electrodes without disturbing an outer, cooler portion thereof. Now, an improved furnace side wall construction has been developed which will increase the life of the furnace and particularly its wall defining refractories, which will enable beneficial usage of heat removed from its refractory wall, and which will enable separate maintenance of an upper refractory mouth portion thereof.

BRIEF SUMMARY OF THE INVENTION

This invention relates to an improved electric arc metal melting furnace construction which will enable a better temperature control of a melting operation and, at the same time, assure an increased operating life of the refractories used in its wall construction.

It has thus been an object of the invention to provide an improved electrode melting furnace construction that will increase its flexibility from the standpoint of temperature control and will better enable a more uniform application of melting temperature about its side wall.

Another object has been to devise an improved furnace that will not only enable an efficient cooling of its refractory side wall during a melting operation, but will enable an effective utilization of warmed cooling fluid that is exhausted from chambered portions of the wall.

A further object of the invention has been to provide a furnace having an increased overhead or open mouth area from the standpoint of its upper ring structure, and which area may be independently lifted-off, repaired and returned to its operating position without disturbing a main side wall portion of the furnace.

These and other objects of the invention will appear to those skilled in the art from the description of exemplary embodiments as well as from the appended claims.

Figure 2:
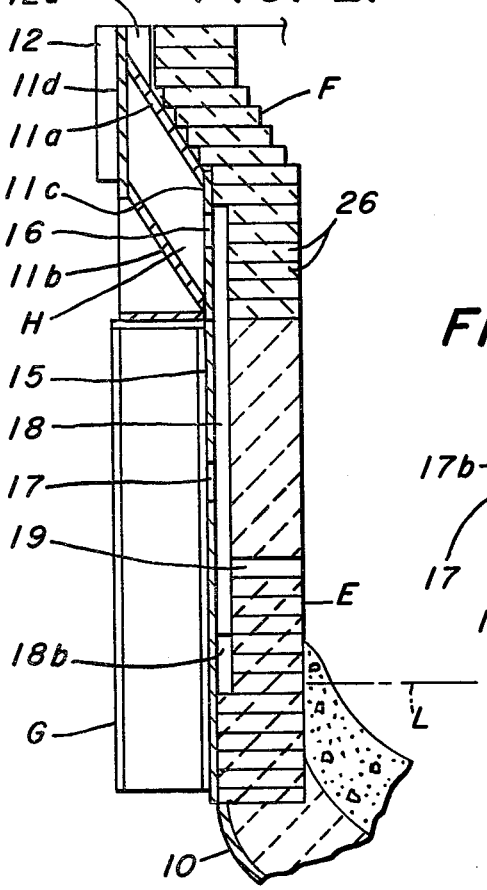
FIG. 2 is an enlarged fragmental vertical section through the wall of the furnace of FIG. 1, particularly illustrating its construction. This section is taken along the line II—II of FIG. 1.
Figure 4:
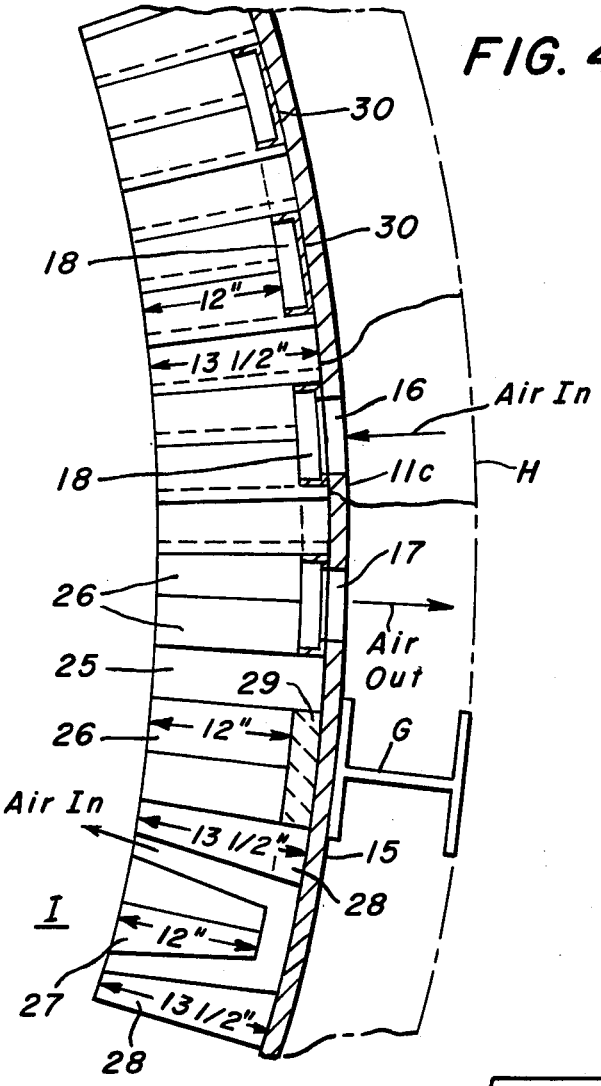
FIG. 4 is a further enlarged horizontal fragmental section through the furnace wall of FIG. 1, particularly showing port means in its refractory side walls, as associated with a metal closure about the side wall, and with outlet or exhaust ports from cooling fluid chambers. In this figure, representative dimensions of refractory tile members are shown to enable a better understanding of their construction and utilization.
Figure 6:
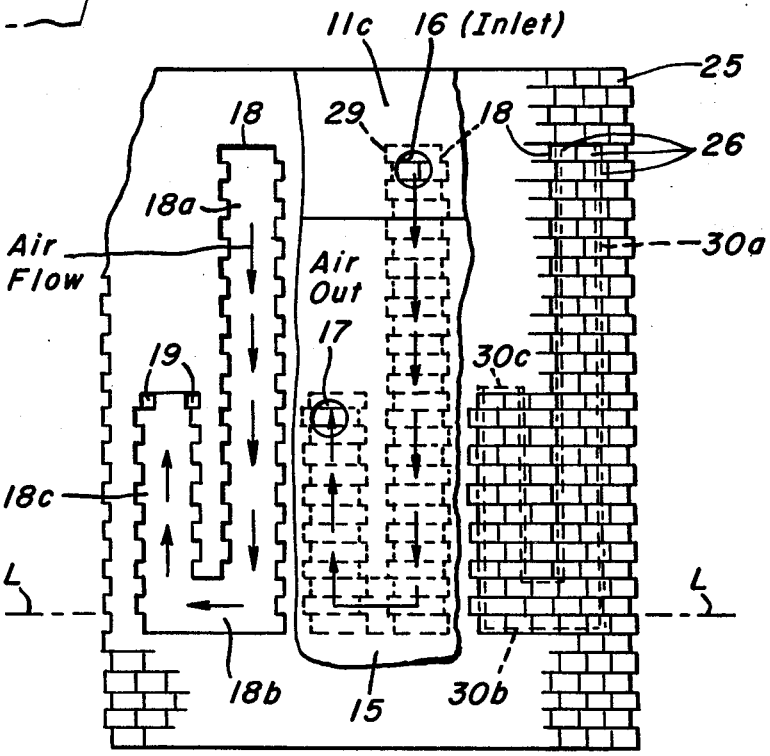
FIG. 6 is a fragmental, somewhat schematic side view in elevation illustrating how the tile wall is constructed to provide a series of J-shaped cooling fluid circulating chambers in a spaced-apart group about the furnace side wall. In this figure, the extreme right hand portion thereof particularly illustrates the arrangement of short and longer length refractory tile members and the employment of shell-like, J-shaped channel members for sealing-off each chamber within the wall; the intermediate or central portion of this figure particularly shows an upper plate member that defines the inside of a ring-like cooling fluid manifold or duct for supplying cooling air to the chambers, and an inner plate-like wall that abuts the refractory tile side wall to, as also shown in FIG. 4, provide an outer sealing wall for the cooling fluid chambers and inlet and outlet ports or holes for the entry of cooling fluid from the duct and for the outflow or discharge of warmed fluid therefrom; and the extreme left hand portion of this figure is illustrative of a J-shaped cooling chamber, itself.
Figure 6A:
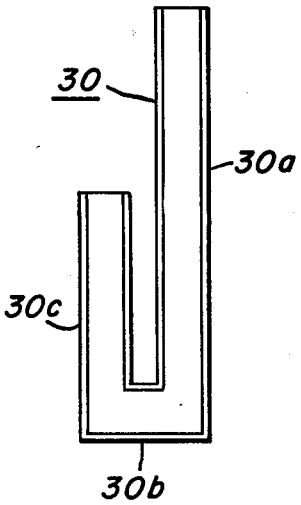

And, FIG. 6A is a view in elevation on the scale of FIG. 6 illustrating a suitable form of U-shaped metal channel for defining each cooling fluid chamber in combination with shorter length refractory tile and an outer metal shell member, see also FIGS. 2 and 4.

DETAILED DESCRIPTION

Figure 1:
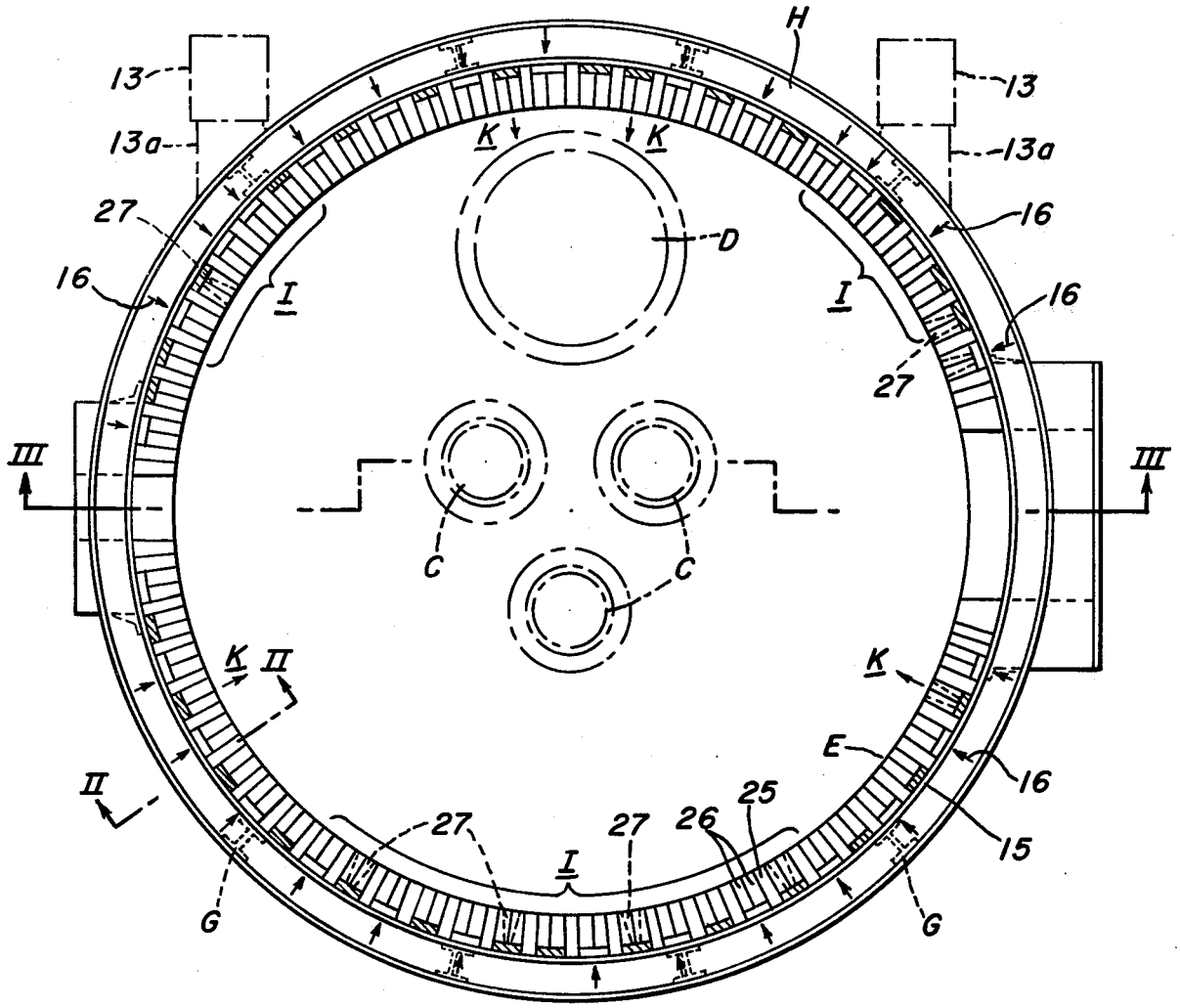
FIG. 1 is a horizontal view through a furnace constructed in accordance with the invention, on the scale of and taken along the line I—I of FIG. 3; it illustrates means for supplying cooling fluid or air under pressure to a surrounding duct and from such duct into J-shaped cooling chambers that are located in its refractory side wall. In this view, dot and dash lines are used to show a representative location of electrode and smoke holes in the roof and of blower means for supplying cooling air to an upper manifold or duct that extends about its open mouth portion.
Figure 3A:
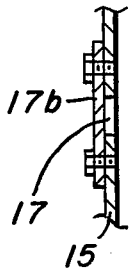
FIG. 3A is a fragmental section illustrating how the exhaust ports may be closed off.
Figure 3:
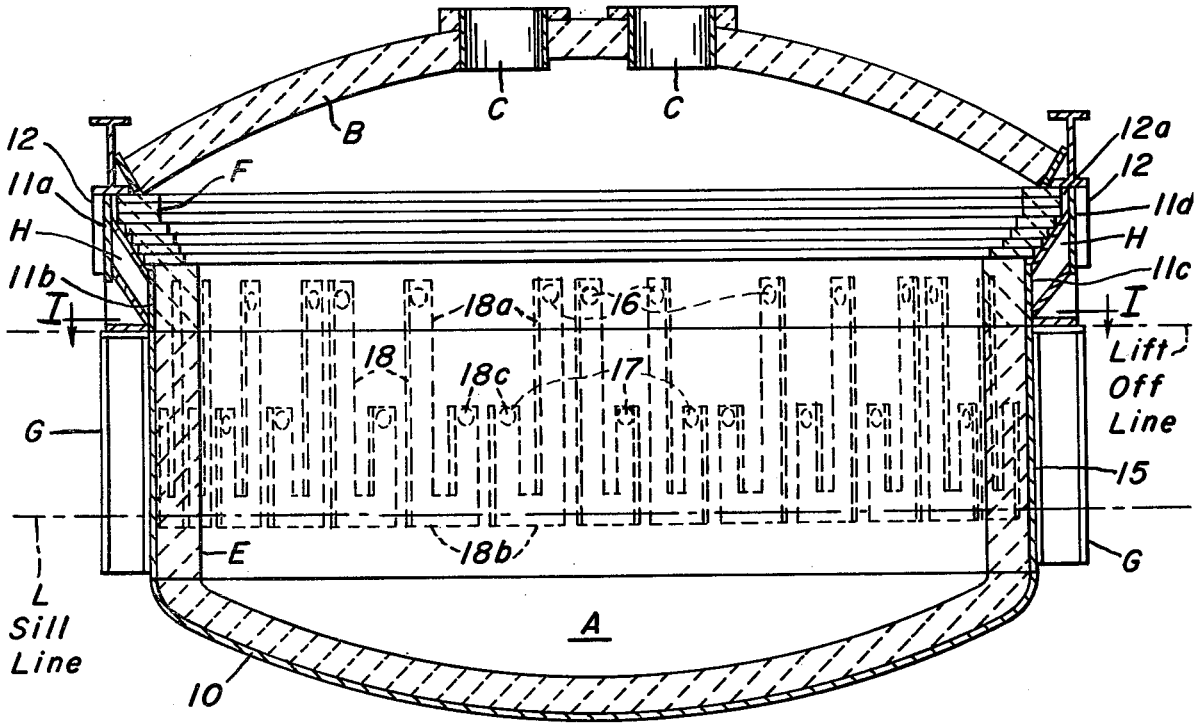
FIG. 3 is a vertical section in elevation on the scale of and taken along the line III—III of FIG. 1, particularly illustrating the use of a group of circumferentially spaced-apart cooling fluid-receiving and passageway-defining chambers in and about the refractory side wall.

With particular reference to FIGS. 1 and 3, an electric arc melting furnace A is shown provided with a conventional sprung roof B of refractory construction, with refractory-lined electrode openings C at equally spaced central locations in its roof, and with a refractory-lined smoke hole portion D in the roof through which furnace fume and smoke may be removed. The furnace A is also shown provided with a conventional rounded refractory bottom portion 10, a substantially cylindrical main side wall E of refractory tile members that extends from the bottom portion 10, and an upper, outwardly diverging, funnel-shaped ledge or beveled, ring-like mouth portion F also of refractory tile member construction.

A peripherally spaced-apart group of upright I-beam members or buckstays G are adapted to extend from and to be fixed within the floor of the plant to provide an outer frame or support for the side wall of the furnace A. The buckstays G also provide an outer support frame for an inner, plate-like metal sheet wall 15 that is adapted to extend about the outer periphery of tile member constructed refractory side wall E. Full length tile members 25 of the side wall E, in cooperation with shorter length tile members 26 or 26', define a group of spaced-apart, J-shaped cooling chambers within and about the side wall E.

Figure 2A:
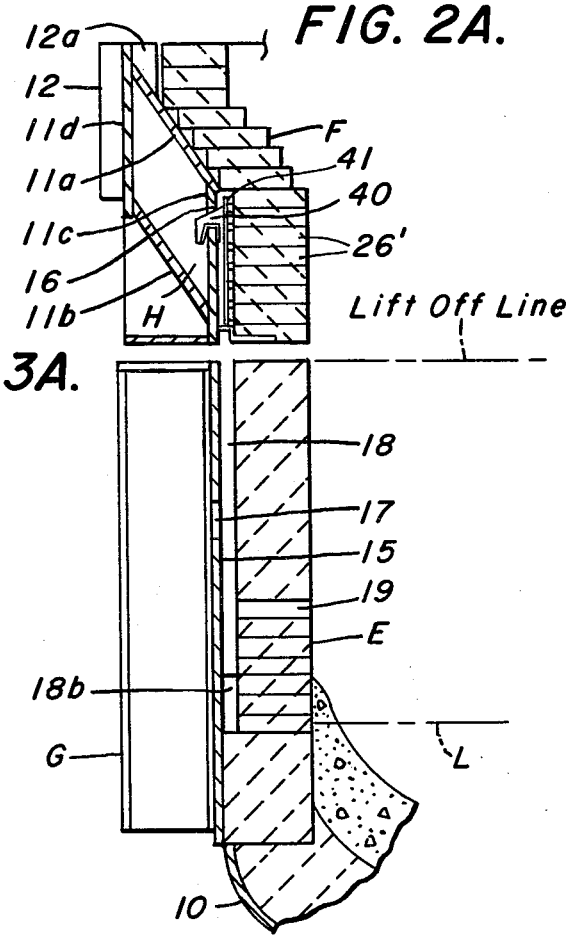
FIG. 2A is a view on the scale of and similar to FIG. 2, but illustrating a modified construction in which hangers are employed for supporting the tile members of an upper, refractory, ring-like mouth or ledge portion that extends in a funnel shape from the main portion of the side wall, and which may be raised and lowered independently of the main side wall portion.

The buckstays G and the metal shell wall **15*a*, as particularly shown in FIGS. 2 and 2A, provide a supporting mounting for an upper metal ring-like structure that includes a cooling fluid or air-carrying duct or manifold H and funnel-shaped refractory tile-defined upper ledge, mouth or ring portion F. As particularly shown in FIG. 1, the duct H extends continuously about the upper mouth portion F of the furnace wall for receiving cooling fluid that, as somewhat diagrammatically shown in FIG. 1, may be supplied from a pair of spaced locations therealong by a pair of back-end-positioned, electric-motor-driven blowers 13 and connecting duct portions 13*a***. The fluid may be supplied from a cooling fluid source or directly taken-off from the ambient atmosphere.

FIGS. 2, 2A and 3 show a group of peripherally spaced-apart, outer reinforcing metal ribs 12 and inner reinforcing pieces or ribs **12*a* that extend vertically along an upper enclosing, front or face plate member 11*d* of the duct H. The duct H is defined, as shown in FIG. 2, by the upper and outer vertical plate member 11*d*, by an inner and lower vertical plate member 11*c*, and by inwardly downwardly sloped top and bottom plate members 11*a* and 11*b*. The inner plate member 11*c* is provided with a circumferentially spaced progression of inlet ports or holes 16 therethrough for introducing cooling fluid from the duct H into each of a series of J-shaped cooling chambers 18, such as illustrated in FIG. 6**.

The left hand and the intermediate or central portions of FIG. 6 indicate how cooling fluid or air from each port 16 is introduced into the upper end of an associated J-shaped chamber 18, then downwardly, as indicated by the arrows, along a longer leg **18*a* of the chamber, horizontally or transversely along a bottom, cross-over or foot portion 18*b*, and then upwardly along a shorter length leg portion 18*c* to finally exhaust at port 17 or opening at the upper end of the shorter leg 18*c*. See also FIGS. 3 and 4**.

It will be noted particularly from FIGS. 2, 3 and 4 that the horizontal foot portions **18*b* of the cooling chambers 18 slightly overlap or lie along a sill line L which represents the furnace slag line adjacent the bottom 10** of the furnace A and thus, the hottest portion thereof.

In FIG. 2A, a slightly modified structure is shown which employs hanger castings 40 that extend at spaced locations from port holes in the back wall member **11*c* of the manifold or duct H. The fit of the hook of each hanger 40 within the opening 16 may be a somewhat loose one from the standpoint that cooling fluid may be permitted to pass from the duct H into the chambers 18 therethrough. However, if desired, separate ports like the ports 16 of FIG. 2, may be employed. In this construction the metal work of the duct H, including the hangers 40, forms an outer and a bottom support for the short length refractory tiles 26' and for upper, staggered, funnel-defining tiles of the full vertical extent of the mouth portion F, such that an overhead sling or hoist may be engaged within holes (not shown) in reinforcing pieces or ribs 12 or 12*a*. Since the hangers 40 provide a support for the tile members independently of the side wall E, as shown in FIG. 2A, the upper ring-like mouth or ledge portion F and the manifold H may be lifted as a unit off the furnace for maintenance and repair. After repair, the assembly may be lowered back into a cooperating position with the main side wall E of the furnace. Since this mouth portion F of the furnace is a portion subjected to the greater wear and tear than the wall portion E from the standpoint of scrap damage, etc., this arrangement enables a quick and inexpensive repair of the upper portion without disturbing the main side wall E of the structure. In FIG. 2A**, the upper ring-like ledge F including the manifold H is shown in a slightly raised position such as may be effected by the use of an overhead hoist or sling.

As further illustrated herein, the warmed air or fluid which has served its cooling function, in first moving into the duct H along the outside of the ledge portion F, and then as indicated in FIG. 6, may be exhausted from the ports 17 and/or utilized in a number of ways. For example, as indicated in FIG. 1, it has been determined that there are inner areas about the refractory wall, such as K, which are cooler areas by reason of their distance from the electrodes or their nearness to the outflow of fume. There are also areas, such as represented by I, that are hotter. It has been found desirable, both from the standpoint of a better melting operation, and from the standpoint of maximizing the life of the refractory tile members of the wall E to provide a more uniform temperature along its full inner periphery.

The present construction enables the carrying out of such a purpose, in that warmed fluid exhausting adjacent the ports 17 can be introduced through a spaced progression of passageway-defining entry tile members 27 each of which, as shown by the left hand "Air In" arrow in FIG. 4, has a V-shaped port that may be used to introduce the warmed air from the ports 17 directly into the furnace at hotter spots or areas, such as I, to lower their temperature. As also shown by a right-hand directed arrow in FIG. 4, a portion or all of the warmed air may be directly discharged outwardly of the furnace wall, for example, to heat a plant area or to supply warmed fluid or air through ductwork to provide hot processing fluid for other operations in a plant.

Figure 5:
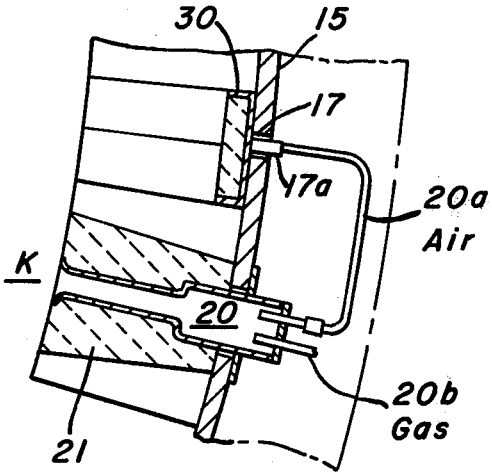
FIG. 5 is a fragmental horizontal section on the scale of FIG. 4, illustrating how one or more burners may be used at spaced locations about the outer periphery of the furnace side wall, for example, at so-called cooler areas or spots therealong which, as illustrated in FIG. 1, are located between so-called hot spots or areas thereof.

In FIG. 5, an arrangement is illustrated for further heating the warmed air as supplied through one or more of the ports 17 by employing it in a burner 20 that is positioned to extend at colder spots or areas K through a specially shaped throat-defining tile member 21. In this figure, warmed air is taken from a fitting 17a at the port 17 and supplied through a tubing or pipe 20a to the burner 20, along with an external supply of combustible gas through tubing or pipe 20b. When it is desired (see FIG. 3A) to directly supply the heated fluid from a port 17 to the inside of the furnace, a closure plate 17b may be secured or bolted in position over the open portion in the shell wall 15 to close it off from the standpoint of the ambient atmosphere, whereby the port area will only open, as shown at the bottom portion of FIG. 4, into the inlet chamber of an adjacent entry tile member 27 to, for example, an inside area I.

A chamber closing-off, relatively thin wall, metal channel, such as 30 of FIG. 6A, has legs 30a and 30c and a foot 30b (see also FIG. 6) the same as an associated chamber 18. The channel 30 extends inwardly of the refractory portion of the chamber 18 and along the side edges thereof; its back wall serves as an outer wall for an associated chamber 18, and its side edge flanges define opposite sides of the passageway along the associated chamber; also its web portion may rest against or abut the inside of the metal shell wall 15 (see FIG. 4). The ports 16 and 17 thus also open through the members 30. Spaces between short length refractory tile members 26 and longer or full length members 25 and side flanges of the associated channel 30 may be filled-in with conventional furnace cement.

Assuming that two relatively small 6,000 cu. ft./minutes blower units 13 are used for supplying cooling fluid or air to the duct or manifold H, and also assuming that there are about twenty-eight cooling chamber 18, each will then receive about 430 cu. ft./minute of cooling fluid. Since each chamber 18 may have about ten square feet of cooling surface, the fluid or air supply will then approximate about 43 cut ft./minute/square foot which provides a very efficient action. By using spaced-apart alternate cooling chambers 18, the furnace A will be fully capable of withstanding pounding from metal scrap charging, and about 33% of the upper wall surface at the longer leg 18a, about 66% across the two legs 18a and 18c, and about 85% at the bottom foot or crossover 18b which lies along the slag line may be cooled. In this manner, about 70% of the wall area may be cooled. The upper, outward taper of the ledge or ring that defines the mouth portion F of the furnace is also cooled, since it is backed-up by the fluid-carrying duct H. This will result in an increased movement of effective melting heats for the life of the furnace side wall portions.

The construction provides a cooling pattern along the refractory side portions of the furnace A that, in effect, fits the wear behavior thereof. Although the chambers 18 are defined within and by the refractory tile member wall construction, the metal members 30 serve to back-up the tile facing and, are in turn, backed-up by the metal shell wall 15. The construction enables a faster speed of melting without damage to the refractories and the separate rim flange construction enables a substantial doubling of the number of heats that may be accomplished without repair of the main side wall E. It will be noted that the cooling fluid flow is a substantially parallel flow along and within outer face portions of the main side wall E.

I claim:

1. In an improved electric furnace having an upright refractory enclosing side wall that terminates in an upper open mouth portion for receiving an overhead enclosing roof through which electrodes are adapted to centrally extend and with respect to which fumes and smoke are adapted to exhaust, the improvement which comprises, a duct about the upper open mouth portion of the refractory side wall, means for supplying cooling fluid to said duct, outer closure means along the refractory side wall, a group of circumferentially spaced-apart cooling-fluid-receiving and passageway-defining chambers along the refractory side wall and between it and said outer closure means, each of said chambers having one end portion connected to receive cooling fluid from said duct and having an opposite end portion connected to discharge warmed fluid therefrom.

2. In an improved furnace as defined in claim 1, said group of chambers being defined between said outer closure and shorter length refractory tile members of said side wall, and the opposite end portion of each of said chambers being a lower end portion that discharges warmed fluid therefrom.

3. In an improved furnace as defined in claim 2, said group of chambers being of J-shape, an upper end of each J-shaped chamber being connected to receive cooling fluid from said duct, and the lower end portion of each said chamber having port means to dicharge warmed fluid therefrom.

4. In an improved furnace as defined in claim 3, back-up metal positioned along said J-shaped chambers to seal them off with respect to adjacent portions of the refractory side wall.

5. In an improved furnace as defined in claim 4, said outer closure means being of metal construction and abutting said back-up metal.

6. In an improved furnace as defined in claim 1, inlet ports in a spaced relation along said duct open to the one end portion of each of said cooling-fluid-receiving chambers, and outlet ports connected to the opposite end portion of each of said fluid-receiving-chambers for discharging warmed fluid therefrom.

7. In an improved furnace as defined in claim 6, said duct being of ring-like metal construction about the open mouth portion of the refractory side wall, said outer closure being of plate-like metal construction and extending in a relatively close fitting relation with respect to said group of cooling-fluid-receiving chambers.

8. In an improved furnace as defined in claim 6, furnace inlet ports at hotter areas along the furnace side wall, and said outlet ports being connected to said furnace inlet ports at circumferentially spaced positions along the furnace side wall to introduce the warmed fluid into the furnace through the side wall thereof at such hotter areas.

9. In an improved furnace as defined in claim 6, at least one furnace inlet port through the furnace side wall at a cooler inside area thereof, a burner positioned at said inlet port and connected to receive warmed air from said outlet port and to receive and mix and burn fuel gas and the warmed air for introducing hot combustion gas into the furnace at such cooler area thereof.

10. In an improved furnace as defined in claim 7, said outer closure having port means therethrough for discharging warmed fluid received from said outlet ports of said group of cooling-fluid-receiving chambers.

11. In an improved furnace as defined in claim 6, blower means connected to said duct for supplying cooling air under pressure thereto for discharge into said cooling-fluid-receiving chambers, and said chambers being defined between short and long length refractory tile members of the furnace side wall.

12. In an improved furnace as defined in claim 11, said chambers being of J-shape, and the base portion of the J-shape extending along a lower portion of the furnace side wall.

13. In an improved furnace as defined in claim 1, the upper open mouth portion being of an upwardly outwardly diverging shape as defined by staggered refractory tile members, and said duct extending in an adjacent relation along the outside of said upper open mouth portion.

14. In an improved furnace as defined in claim 13, hanger means cooperating with said duct for carrying said tile members in a lift-off relation with respect to said furnace side wall.

15. In an improved electric furnace having an upright refractory enclosing side wall of tile member construction that terminates in an upper open mouth portion for receiving an overhead enclosing roof through which electrodes are adapted to centrally extend and with respect to which fume and smoke are adapted to exhaust, the improvement which comprises, a ring-like duct about the outside of the upper open mouth portion of the refractory side wall, means for supplying cooling fluid to said duct, a plate-like enclosure extending downwardly from said duct along and about the refractory side wall, the refractory side wall having shortened dimension refractory tile defining a group of circumferentially spaced-apart J-shaped cooling-fluid-receiving chambers with respect to and along said plate-like enclosure; each said J-shaped chamber having a relatively long downwardly extending leg portion, having a cross-extending foot portion connected at one end to a bottom end of said relatively long leg portion, and having a relatively shorter leg portion extending upwardly from and connected to an opposite end of said foot portion; inlet port means oppen from said duct to an upper end of said relatively long leg portion of each of said chambers for supplying cooling fluid thereto for down-flow therealong, along said foot portion, and upwardly along said shorter leg portion; and outlet port means connected to the upper end of said shorter leg portion of each of said J-shaped chambers for discharging warmed fluid therefrom.

16. A furnace as defined in claim 15 wherein said outlet port means opens outwardly through said plate-like enclosure.

17. A furnace as defined in claim 15 wherein said enclosure has portions extending along bounding portions of said J-shaped chambers to seal them off with respect to adjacent portions of the refractory side wall.

18. A furnace as defined in claim 15 wherein, said means for supplying cooling fluid comprises a pair of fans connected to said duct at spaced locations therealong, and said duct has a series progression of said inlet port means at spaced locations therealong for introducing cooling fluid therefrom into the upper ends of each of said J-shaped chambers.

19. A furnace as defined in claim 15 wherein the refractory side wall has entry refractory tile members thereabout for introducing warmed fluid from said outlet port means into the inside of the furnace.

20. A furnace as defined in claim 15 wherein said outlet port means from said J-shaped chambers is defined by V-shaped refractory tile members at spaced positions within the furnace side wall for introducing the warmed fluid into the furnace.

21. A furnace as defined in claim 20 wherein said entry tile members are of V-shaped passageway defining construction.

* * * * *